United States Patent [19]

Holz

[11] Patent Number: 4,529,519

[45] Date of Patent: Jul. 16, 1985

[54] SCREEN CAGE FOR SEPARATORS FOR SORTING FIBRE SUSPENSIONS

[75] Inventor: Emil Holz, Eningen, Fed. Rep. of Germany

[73] Assignee: Hermann Finckh Maschinenfabrik GmbH Co., Fed. Rep. of Germany

[21] Appl. No.: 488,672

[22] Filed: Apr. 26, 1983

[30] Foreign Application Priority Data

May 4, 1982 [EP] European Pat. Off. ..... 82103801.5

[51] Int. Cl.[3] ..... B01D 29/10

[52] U.S. Cl. ..... 210/497.01; 210/485; 209/393

[58] Field of Search ..... 210/485, 498, 155, 162, 210/159, 499, 295, 415, 314, 315, 348, 497.01; 209/393, 273

[56] References Cited

U.S. PATENT DOCUMENTS

| | | | |
|---|---|---|---|
| 874,418 | 12/1907 | McEvoy | 210/498 |
| 1,375,222 | 4/1921 | Lutz | 210/498 |
| 1,743,953 | 1/1930 | Beatty | 209/273 |
| 1,780,882 | 11/1930 | Kettler | 210/315 |
| 2,998,064 | 8/1961 | Lang | 209/393 |
| 3,250,063 | 5/1966 | Andrews | 210/485 |
| 3,390,774 | 6/1968 | Neely | 210/315 |
| 3,581,903 | 6/1971 | Holz | 210/415 |
| 4,262,744 | 4/1981 | Mitchell et al. | 210/497.01 |
| 4,276,159 | 6/1981 | Lehman | 210/415 |
| 4,309,284 | 1/1982 | Morimoto et al. | 209/273 |
| 4,358,370 | 11/1982 | Jameson et al. | 210/415 |
| 4,415,613 | 11/1983 | Medney | 210/499 |

FOREIGN PATENT DOCUMENTS

| | | | |
|---|---|---|---|
| 545967 | 8/1929 | Fed. Rep. of Germany | 210/498 |
| 1611145 | 9/1970 | Fed. Rep. of Germany . | |
| 30891 | 12/1925 | France | 210/315 |
| 845346 | 12/1938 | France | 210/169 |
| 48947 | 2/1931 | Netherlands | 209/393 |
| 579562 | 8/1946 | United Kingdom . | |
| 681379 | 10/1952 | United Kingdom | 210/315 |
| 841207 | 7/1960 | United Kingdom | 210/315 |
| 879759 | 10/1961 | United Kingdom . | |
| 921593 | 4/1982 | U.S.S.R. | 210/485 |

*Primary Examiner*—Arnold Turk
*Assistant Examiner*—Titus B. Ledbetter
*Attorney, Agent, or Firm*—Kramer and Brufsky

[57] ABSTRACT

Screen cage for pressure sorters, with which, in order to increase the stability of the screen cage wall and the sum total of the inside screen cage apertures, the screen cage wall has a regular pattern of cylindrical recesses on its outlet side and grooves extending parallel to each other on its inflow side, the grooves and the recesses together forming screen aperture slots.

17 Claims, 7 Drawing Figures

SCREEN CAGE FOR SEPARATORS FOR SORTING FIBRE SUSPENSIONS

Figure 1:
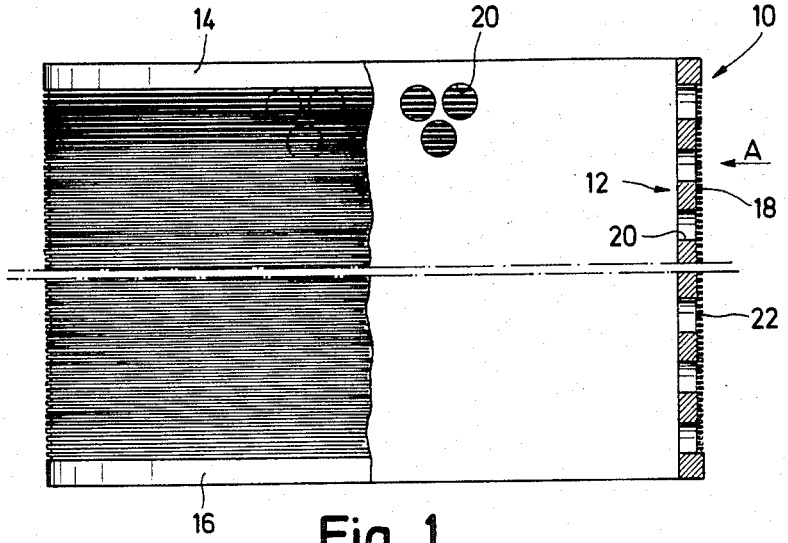

The invention relates to a screen cage for separators for sorting fibre suspensions comprising an inflow side and an outlet side and screen apertures widening in the direction of flow, these screen apertures being slot-shaped on the inflow side. Screen cages of the type in question may be cylindrical or conical in shape and, if necessary, provided with a bottom and/or a cover.

A screen cage of the type mentioned at the beginning, which has slots extending in an axial or circumferential direction, is known, for example, from the applicant's U.S. Pat. No. 3,581,903. Screen cages of this type are manufactured from sheet metal bent and closed to form a circular cylinder, the screen apertures being worked into the sheet metal while it is laid flat. The screen apertures have been designed such that they widen in the direction of flow for the reason that it has been shown that the risk of the screen apertures becoming clogged may be avoided almost completely in this way in conjunction with the cleaning blades or vanes used for the rotors of separators having such a screen cage.

In the case of the known screen cage recesses in the shape of a ship's hull are milled out of the sheet metal for each of the screen apertures, these recesses being milled from the side of the screen cage wall which will later be the outlet side when seen in the plan view. Subsequently, slots are sawn into the same side of the sheet metal using a thin circular saw blade. These slots are each disposed at the "keel" of the recesses. The milling out of the recesses is necessary not only because the screen apertures are to widen in the direction of flow for the reason described above but the difference in pressure between the inflow and outlet sides of the screen cage in so-called pressure sorters also necessitates a relatively thick screen cage wall, into which the fine slots required could not otherwise be sawn. The recesses, which are required for each individual screen aperture and milled out of the screen cage wall, do, however, weaken the screen cage such that reinforcement rings are required in practice, these rings being attached to the outside of the screen cage wall and spaced from each other, so that the screen cage wall is able to withstand the difference in pressure mentioned when it is used in pressure sorters. This will not only make the known screen cages of pressure sorters more expensive but the reinforcement rings also cover a considerable portion of the screen cage surface and for this reason the known screen cages must have relatively large dimensions. This leads to the sorter requiring more energy since the cleaning blades or vanes provided on the sorter rotor have to be longer and/or cover a longer path per rotation of the rotor. This obviously results in an increase in the drive power required for the rotor.

So that the screen aperture slots can be manufactured with a circular saw blade the milled recesses must be of a much greater length than the screen aperture slots themselves. This will weaken the screen cage wall even more. Finally, the transverse spacings between the screen aperture slots have to be selected relatively large so that the crosspieces of the screen cage wall remaining between the screen apertures will give the wall a fairly adequate rigidity. This will, however, reduce the maximum throughput in fibre suspensions through a known screen cage of the type in question and having predetermined dimensions. In addition, the sheets of metal worked in the way described cannot be bent to form perfectly round screen cages because the annular zones, which are not provided with milled recesses and sawn slots but to which the reinforcement rings are attached, do not have the same qualities of deformation as the areas in between, which are provided with screen apertures.

The object underlying the invention was to create a screen cage for separators for sorting fibre suspensions and in particular for pressure sorters, which has screen apertures widening in the direction of flow and being slot-shaped on the inflow side and the wall of which, when the thickness of the wall is predetermined, has a greater rigidity than the known screen cages of the type described even without the use of reinforcement rings or the like.

This object may be accomplished according to the invention in that the screen cage wall is provided on the outlet side with recesses, each of which extends over a plurality of screen aperture slots and which are spaced from each other in all directions such that the screen cage wall on the outlet side has a net structure between the recesses. The recesses in question may be quite simply made by, for example, milling when they are circular-cylindrical in shape. The sheet metal or other material used for the screen cage wall will, of course, be worked in its flat state before the screen cage is formed from it.

If the recesses are not exactly given a rectangular shape with edges parallel to the screen aperture slots the inventive construction will lead to screen aperture slots of differing lengths which is advantageous amongst other reasons because the stability of the resulting screen cage comes close to that of a screen cage provided with bored perforations. When the recesses form a regular pattern and are, in particular, circular-cylindrical in shape the screen cage wall may also be bent to form an absolutely round screen cage without any great difficulty since the screen cage wall does not then have to be aligned in any preferred direction with regard to its bending resistance.

Since the reinforcement rings previously used are no longer required a screen cage having a predetermined maximum throughput may be reduced in size such that the motive energy required for the rotor can be reduced by up to 20%. A further saving in energy is possible due to the fact that the total screen surface may be reduced by up to approximately 23% as it is no longer necessary to have wall areas not provided with milled recesses, as was the case for the known screen cages.

Figure 2:
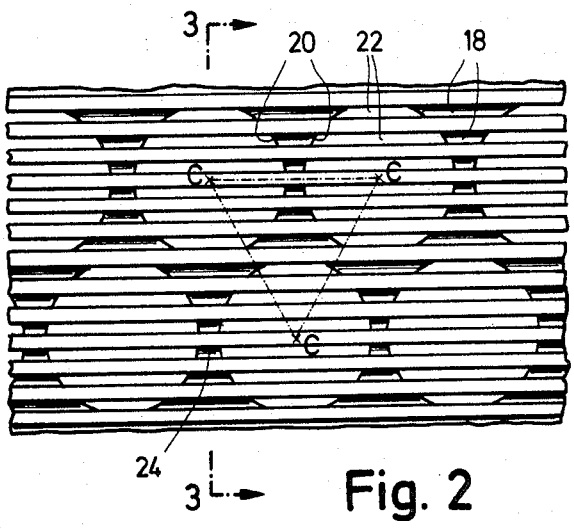
Figure 3:
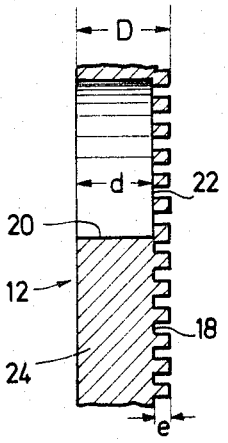
Figure 4:
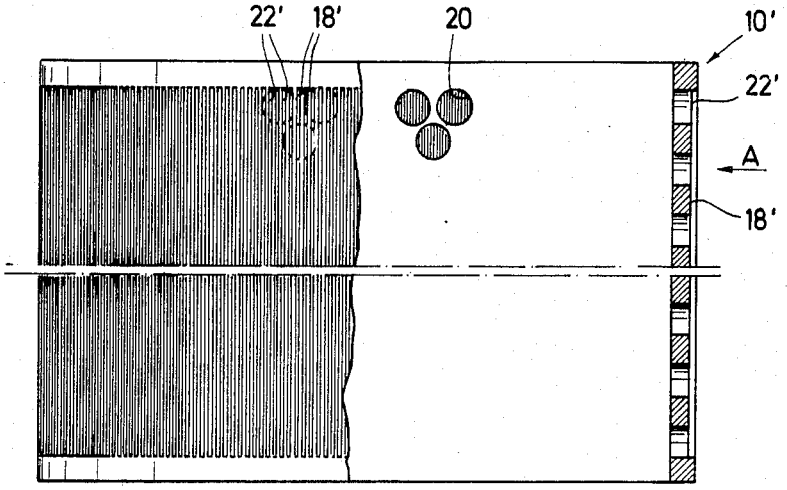
Figure 5:
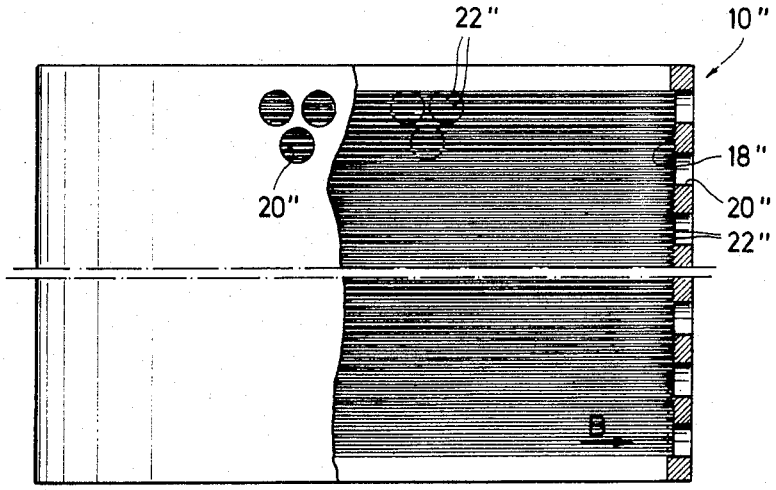
Figure 6:
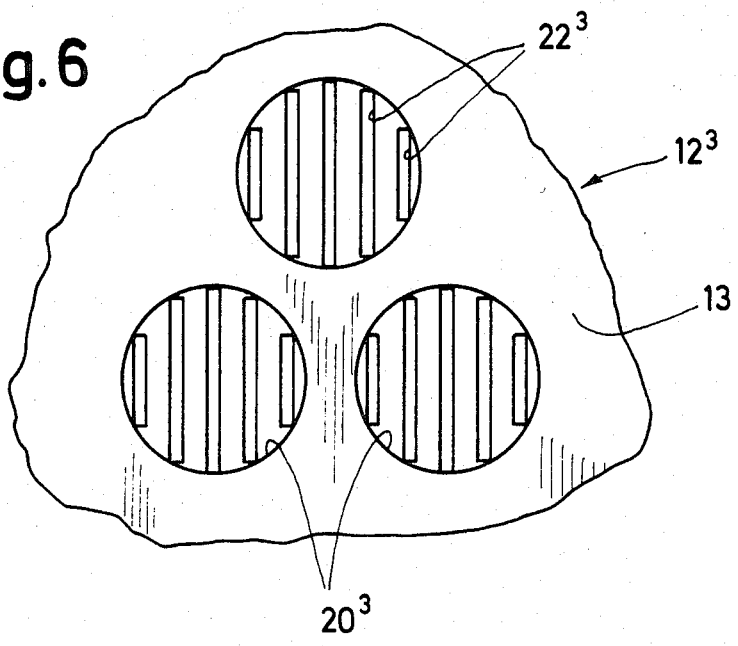
Figure 7:
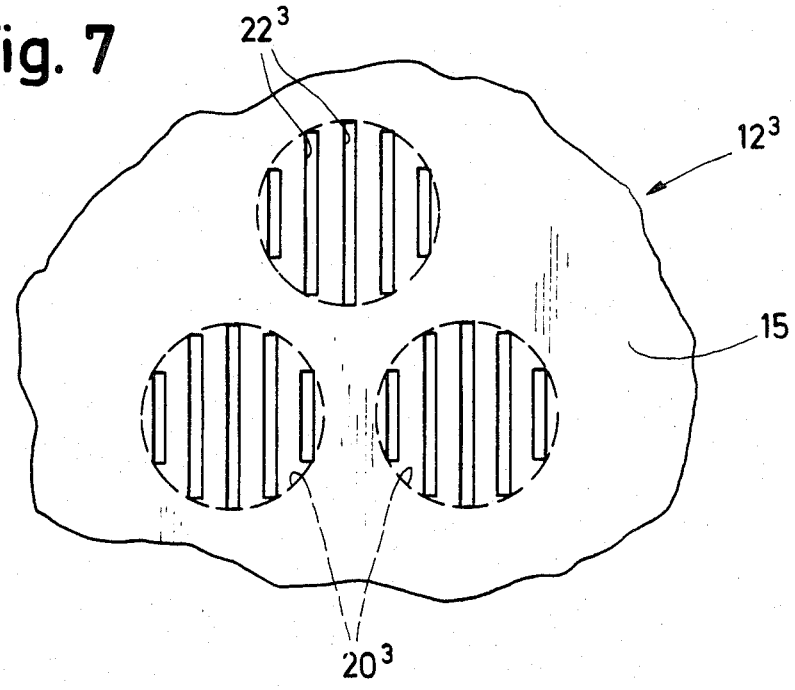

Additional features, details and advantages of the invention are specified in the attached claims and/or the following specification as well as the attached drawings of preferred embodiments of the inventive screen cage; the drawings show:

FIG. 1 a side view, partly cut away, of a first embodiment of the screen cage;

FIG. 2 an enlarged illustration of a surface area of the screen cage, as seen from the outside;

FIG. 3 a section along line 3—3 in FIG. 2;

FIG. 4 an illustration of a second embodiment corresponding to FIG. 1;

FIG. 5 an illustration of a third embodiment corresponding to FIGS. 1 and 4;

FIG. 6 an illustration of a fourth embodiment corresponding to FIG. 3 (view of the outlet side of a portion of the screen cage wall), and FIG. 7 a view of the inflow side of a portion of the screen cage wall of the fourth embodiment.

FIGS. 1 to 3 show a screen cage 10 for a pressure sorter, in which the fibre suspension to be sorted flows through the screen cage from the outside to the inside, i.e. in the direction of arrow A in FIG. 1. The screen cage wall 12 has upper and lower annular regions 14 and 16, respectively, without screen apertures for mounting the screen cage in the pressure sorter. Between these two regions the outside of the screen cage wall is provided with circumferential grooves 18, which are spaced at equal distances from each other, while circular-cylindrical recesses 20 have been milled out from the inside of the screen cage wall. These recesses 20 are of such a depth that screen aperture slots 22 result in the region where the circumferential grooves 18 and the recesses 20 overlap. In the case of the preferred embodiment of the inventive screen cage the centres of the recesses 20, which are designated "C" in FIG. 2, form the corners of an equilateral triangle, which is indicated in FIG. 2 by a dash-dot line for three adjacent recesses. In this way the non-perforated regions 24 of the screen cage wall 12 form a net structure between the recesses 20, which lends the necessary rigidity to the screen cage wall 12.

For reasons of manufacture it is recommended that the depth "d" of the recesses 20 and depth "e" of the grooves 18 be selected such that their sum total is somewhat larger than the original thickness "D" of the screen cage wall 12. In the case of the preferred embodiment the depth of the recesses 20 is to be such that the value (D−d) is approximately 0.8 to 1.2 mm while "e" is approximately 0.9 to 1.3 mm. Whereas the embodiment of FIGS. 1 to 3 has screen aperture slots 22 extending in a circumferential direction the screen cage 10' shown in FIG. 4, through which the flow is also from the outside to the inside, has grooves 18' extending in an axial direction so that the screen aperture slots 22' also extend in an axial direction.

The flow through the screen cage 10'' illustrated in FIG. 5 as the third embodiment is from the inside to the outside, i.e. in the direction of arrow B. Circumferential grooves 18'' are located on the inside while circular-cylindrical recesses 20'' are located on the outside of the screen cage. The screen aperture slots extend in this case in a circumferential direction and are designated 22''.

It is obvious that the grooves 18, 18' and 18'' do not necessarily have to extend in a circumferential direction or in the direction of the axis of the screen cage; it would also be possible, for example, for the grooves 18' to form an acute angle with the vertical.

The additional embodiment according to FIGS. 6 and 7 does not have any grooves extending in either the circumferential or axial directions of the screen cage. After circular-cylindrical recesses $20^3$ have been produced in the screen cage wall $12^3$ from the outlet side 13, screen aperture slots $22^3$ are cut into the screen cage wall by means of a laser or by spark erosion, these slots each ending within the recesses $20^3$. Such an inventive screen cage is characterized by an even greater stability since the screen cage wall is no longer weakened by grooves 18, 18' or 18'' located outside the recesses.

A screen cage has therefore been created by the invention, with which both the sum total of the inside apertures in the screen cage wall and the stability of the screen cage wall are greater than in the case of known screen cages having slot-like screen apertures widening in the direction of flow (with predetermined values for the height and diameter of the screen cage). This results inter alia from the fact that the screen cage is perforated all over except for the regions, by which it is installed.

What is claimed is:

1. A screen cage for separators for sorting fibre suspensions comprising a unitary screen cage wall which has an inflow side, an outlet side and a plurality of screen apertures which are provided by slots extending along the inflow side and penetrate from this side into the screen cage wall, said screen cage wall also having recesses penetrating from the outlet side into the screen cage wall, each recess extending over a plurality of screen aperture slots and the recesses being spaced from each other in all directions such that the screen cage wall on the outlet side has a net structure between the recesses, the depth of said recesses plus the depth of said slots being equal to the thickness of the screen cage wall in the areas where the recesses extend over the screen aperture slots.

2. A screen cage according to claim 1 wherein the recesses form a regular pattern in all directions.

3. A screen cage according to claim 1 wherein the thickness of the screen cage wall remaining at the base of the recesses is approximately 1 mm.

4. A screen cage according to claim 1 wherein the thickness of the screen cage wall remaining at the base of the recesses is between approximately 0.8 mm and approximately 1.2 mm.

5. A screen cage according to claim 1 wherein the screen aperture slots on the inflow side of the screen cage wall do not extend over more than one recess.

6. A screen cage according to claim 1 wherein the recesses are cylindrical in shape.

7. A screen cage according to claim 6 wherein the recesses form a regular pattern in all directions.

8. A screen cage according to claim 7 wherein when the screen cage wall is laid flat, the centers of the recesses form the corners of equilateral triangles.

9. A screen cage according to claim 1 wherein the screen cage wall on the inflow side has grooves running parallel to each other and extending over several recesses.

10. A screen cage according to claim 9 wherein the grooves extend in the circumferential direction of the screen cage, each groove being a complete annular groove.

11. a screen cage according to claim 9 wherein the grooves are disposed at equal distances from each other.

12. A screen cage according to claim 9 wherein the depth of the grooves is between approximately 0.9 mm and approximately 1.3 mm.

13. A screen cage according to claim 9 wherein the grooves extend at least approximately in the direction of the screen cage axis.

14. A screen cage according to claim 13 wherein the grooves end at a distance from the ends of the screen cage.

15. A screen cage according to claim 9 wherein the depth of the grooves is approximately 1 mm.

16. A screen cage according to claim 15 wherein the thickness of the screen cage wall remaining at the base of the recesses is approximately 1 mm.

17. A screen cage according to claim 16 wherein the depth of the grooves is slightly greater than the thickness of the screen cage wall remaining at the base of the recesses.

* * * * *